US006793315B2

(12) United States Patent
Mitsuzawa et al.

(10) Patent No.: US 6,793,315 B2
(45) Date of Patent: Sep. 21, 2004

(54) INK JET RECORDING APPARATUS AND FLUSHING CONTROL METHOD USED IN THE SAME

(75) Inventors: Toyohiko Mitsuzawa, Nagano (JP); Katsuhiro Komatsu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/425,793

(22) Filed: Apr. 30, 2003

(65) Prior Publication Data

US 2003/0202033 A1 Oct. 30, 2003

Related U.S. Application Data

(63) Continuation of application No. 09/877,255, filed on Jun. 11, 2001, now Pat. No. 6,616,264.

(30) Foreign Application Priority Data

Jun. 9, 2000 (JP) ..... P.2000-173017

(51) Int. Cl.[7] ..... B41J 2/165
(52) U.S. Cl. ..... 347/23; 347/32
(58) Field of Search ..... 347/23, 24, 29, 347/31, 32, 35

(56) References Cited

U.S. PATENT DOCUMENTS

| | | | | |
|---|---|---|---|---|
| 4,967,204 | A | 10/1990 | Terasawa et al. | |
| 5,250,962 | A | 10/1993 | Fisher et al. | |
| 5,481,282 | A | 1/1996 | Iwata | |
| 5,483,266 | A | 1/1996 | Nakamura | |
| 5,508,722 | A | 4/1996 | Saito et al. | |
| 5,583,547 | A | 12/1996 | Gast et al. | |
| 5,831,646 | A | 11/1998 | Kuronuma et al. | |
| 6,050,671 | A | 4/2000 | Rotering | |
| 6,340,217 | B1 | 1/2002 | Ebisawa et al. | |
| 6,382,764 | B1 | 5/2002 | Shimoda | |
| 6,616,264 | B2 * | 9/2003 | Mitsuzawa et al. | 347/23 |

FOREIGN PATENT DOCUMENTS

| | | |
|---|---|---|
| EP | 0 589 581 A2 | 3/1994 |
| EP | 0 988 975 A2 | 3/2000 |

* cited by examiner

*Primary Examiner*—Lamson Nguyen
*Assistant Examiner*—Blaise Mouttet
(74) *Attorney, Agent, or Firm*—Sughrue Mion, PLLC

(57) ABSTRACT

An ink jet recording head is provided with a nozzle formation face on which nozzles for ejecting ink drops in accordance with print data are formed. A capping member for sealing the nozzle formation face has an inner space formed with a bottom. An ink absorbing member is provided on the bottom of the inner space. In a first flushing mode, ink drops are ejected into the capping member in a state that the nozzle formation face is sealed by the capping member. In a second flushing mode, ink drops are ejected into the capping member in a state that the capping member is separated from the nozzle formation face. Either the first flushing mode or the second flushing mode is selectively performed.

15 Claims, 12 Drawing Sheets

INK JET RECORDING APPARATUS AND FLUSHING CONTROL METHOD USED IN THE SAME

This is a continuation of application Ser. No. 09/877,255 filed Jun. 11, 2001 now U.S. Pat. No. 6,616,264; the disclosure of which is incorporated herein by reference.

BACKGROUND OF THE INVENTION

The present invention relates to ink jet recording apparatus provided with a recording head for ejecting ink drops in accordance with print data. More particularly, the invention relates to a management technique which solves a problem arising from executing a flushing operation to idly eject ink drops to a capping member for hermetically closing a nozzle formation face of the recording head, and which suppresses the solidification of the ink and the like within the capping member by appropriately managing a flushing amount.

Generally, the ink jet recording apparatus is provided with the ink jet recording head for receiving ink from ink cartridge, and a sheet feeder for moving a recording sheet of paper relative to the recording head. An image is recorded on the recording sheet in a manner that ink drops are ejected onto the recording sheet in accordance with print data while moving the recording head in the main scanning direction. In the recording head, to print, ink is pressurized within a pressure generating chamber and ejected in the form of ink drops onto the recording sheet through the nozzle orifices. Therefore, the nozzle orifices are frequently clogged, and this results in improper printing. Various causes of the nozzle clogging exist, and examples of them are increase of ink viscosity due to solvent evaporation through the nozzle orifices, ink solidification, dust adhesion to the orifices, and entering of air bubbles.

To avoid the clogging trouble, this type of the ink jet recording apparatus uses a capping member for hermetically closing the nozzle formation face of the recording head in a non-print mode. The capping member serves as a lid for preventing the ink at the nozzle orifices of the recording head from being dried. Further, it serves to recover the ink drops ejection ability of the recording head. That is, when the nozzle orifices are clogged, the nozzle formation face is sealed with the capping member, a negative pressure is applied from a suction pump to the clogged nozzle orifices to forcibly suck the ink therefrom. In this way, the clogging of the nozzle orifices is removed.

A process of forcibly sucking the ink from the clogged nozzle orifices, which is executed for removing the clogging of the recording head, is called a cleaning operation. It is executed when the printing is started again after a long power-down time of the apparatus or when the user recognizes printing failure and operates a cleaning switch, for example. In the cleaning operation, under negative pressure generated by the suction pump, the ink is sucked into the capping member from the recording head, and then the nozzle formation face is wiped out with a wiping member formed of a rubber material, for example.

A drive signal, which is not related to the printing, may be applied to the recording head, thereby causing the recording head to eject ink drops. This operation is called a flushing operation. Uneven meniscuses at the nozzle orifices of the recording head are reshaped into the original states through the wiping operation by the wiping member. In the nozzle orifices which are infrequently used for ejecting ink drops during the printing operation, the ink located thereat is likely to increase its viscosity. Accordingly, those nozzle orifices are frequently clogged with the ink of increased viscosity. To avoid this, it is periodically executed.

Meanwhile, the flushing operation is executed to prevent the nozzle orifices having a less chance of ejecting ink drops during the printing operation from being clogged, as mentioned above. Additionally, it is executed for preventing the nozzle orifices from being dried when the recording head is out of operation by moistening the ink absorbing member located within the capping member with the ink.

Recently, the printing has been diversified, and use of the ink containing pigment is a trend in this field. Further, a technique also exists which adds surfactant to the ink composition in order to quicken the fixing of the pigment onto the recording sheet. In the pigment contained ink, a problem that bubbles are generated in the capping member arises. The generated bubbles will destroy the meniscus formed at the nozzle orifices, so that ejection failure occurs. A possible means to avoid the printing trouble of the recording head owing to such ink bubbles is to deepen the capping member to have the deep inner bottom part so that the ink bubbles are away from the nozzle formation face.

In a case where the capping member having the deep inner bottom part is employed, the following problems arises anew. When the flushing operation is executed, ink drops ejected from the nozzle orifices are impeded by air resistance and the like during their flight, and transformed into finer ink drops (ink mist) since a distance between the nozzle formation face and the bottom part of the capping member is large. The ink mist tends to leak out from the space defined between the nozzle formation face of the recording head and the capping member, and floats within the recording apparatus.

The ink mist floating within the apparatus stick to the guide rod for moving the carriage or the like, soils the same, thereby making the carriage movement difficult. Further, the ink mist soils other mechanisms. As a result, the normal operation of the recording apparatus is lost. The ink mist also soils the recording sheet under printing.

A specific color ink of the pigment-contained ink is easy to solidify at a specific position within the capping member, through the repeated flushing operations. In an extreme case, the solidified ink is accumulated into a mountain-like shape. When the recording head is sealed with the capping member, there is a chance that the accumulated ink reaches the nozzle formation face.

SUMMARY OF THE INVENTION

The present invention is directed to solve the problems arising from the flushing operation, and has an object to provide an flushing control method which selects an operation mode to execute a flushing process in a state that the nozzle formation face of the recording head is sealed with the capping member in particular when a flushing amount is large, and solves the problem of the accumulation of the solidified specific color ink, and ink jet recording apparatus which guarantees a high print quality for a long time.

In order to achieve the above object, there is provided an ink jet recording apparatus, comprising:

- an ink jet recording head, provided with a nozzle formation face on which nozzle orifices for ejecting ink drops in accordance with print data are formed;
- a capping member, which seals the nozzle formation face, the capping member having an inner space formed with a bottom;
- an ink absorbing member, provided on the bottom of the inner space in the capping member;

a first flushing mode, in which ink drops are ejected into the capping member in a state that the nozzle formation face is sealed by the capping member; and a second flushing mode, in which ink drops are ejected into the capping member in a state that the capping member is separated from the nozzle formation face, wherein either the first flushing mode or the second flushing mode is selectively performed.

Preferably, the number of ink drops ejected in the first flushing mode is greater than the number of ink drops ejected in the second flushing mode. In other words, when the first flushing mode is selected which is executed in a state that the nozzle formation face of the recording head is hermetically closed with the capping member.

In this configuration, the ink mist generated in the flushing operation is remarkably reduced, even if a distance between the nozzle formation face and the ink absorbing member is made large.

Preferably, ink drops are ejected while varying a distance between the nozzle formation face and the ink absorbing member in accordance with a kind of ink ejected, when the second flushing mode is performed.

In this configuration, generation of the ink mist by the specific ink which is easy to generate ink mist is effectively suppressed.

Preferably, ink drops of different kinds of inks are ejected so as to land on a substantially identical position on the ink absorbing member, when the second flushing mode is performed. Here, it is preferable that ink drops of a first kind of ink which is easy to solidify are first ejected, and then ink drops of a second kind of ink which is hard to solidify are ejected.

In this configuration, the accumulation of the solidified ink is remarkably reduced. In other words, the technical feature successfully solves the ink solidification and accumulation problem, which arises from the fact that the flushing operation using a small amount of ink is frequently performed at substantially the same position of the ink absorbing member.

Preferably, the number of ink ejected is varied in accordance with a kind of ink ejected, when the first flushing mode and the second flushing mode are performed.

In this configuration, the ink being easy to increase its viscosity at the nozzle orifices can be positively discharged. Accordingly, the running cost of the recording apparatus on the ink consumption is reduced when comparing with the recording apparatus in which the number of ejecting operations is set at a fixed value for every kind of ink.

Preferably, the recording apparatus further comprises: a flushing amount counter, which counts an accumulated number of ink drops ejected when the first flushing mode and the second flushing mode are performed; and a suction member, which is communicated with the inner space of the capping member to suck ink therein. Here, the suction member performs an idle suction, in which a part of ink absorbed in the ink absorbing member is sucked while the capping member is separated from the nozzle formation face, when the flushing amount counter counts a predetermined value.

Here, it is preferable that the flushing amount counter is reset when the suction member performs the idle suction.

Here, it is preferable that the second flushing mode is performed at least one of when: every time when a first time period is elapsed; and a recording paper is discharged from the apparatus. On the other hand, the first flushing mode is performed at least one of when:

every time when a second time period which is longer than the first time period is elapsed; a power-off instruction of the apparatus is issued; and a recording paper is discharged from the apparatus.

According to the present invention, there is also provided a flushing control method for the above ink jet recording apparatus comprising the steps of:

counting an accumulated number of ink drops ejected;

judging the accumulated number reaches a predetermined value;

performing an idle suction, in which a part of ink absorbed in the ink absorbing member is sucked while the capping member is separated from the nozzle formation face, when the accumulated number reaches a predetermined value; and resetting the accumulated number when the idle suction is performed.

Preferably, the method further comprises the steps of: counting a first time period; and performing the second flushing mode every time when the first time period is elapsed. Here, the accumulated number counting step includes the step of counting the number of ink drops ejected when the second flushing mode is performed.

Further, it is preferable that the method further comprises the step of counting a second time period which is longer than the first time period. Here, the accumulated number judging step is executed every time when the second time period is elapsed.

Here, it is preferable that the method further comprises the step of performing the first flushing mode when the accumulated number does not reaches the predetermined value. The accumulated number counting step includes the step of counting the number of ink drops ejected when the first flushing mode is performed.

Further, the method further comprises the step of detecting whether a power-off instruction of the recording apparatus is issued. Here, the accumulated number judging step is executed when the power-off instruction is detected.

Here, it is preferable that the step of performing the first flushing mode when the accumulated number does not reaches the predetermined value. The accumulated number counting step includes the step of counting the number of ink drops ejected when the first flushing mode is performed.

Still further, the method further comprises the steps of: counting a second time period which is longer than the first time period; judging whether a recording paper is discharged from the recording apparatus; and judging whether the second time period is elapsed when the recording paper is discharged. Here, the accumulated number judging step is executed when the second time period is elapsed.

Here, it is preferable that the method further comprises the step of performing the first flushing mode when the accumulated number does not reaches the predetermined value. The accumulated number counting step includes the step of counting the number of ink drops ejected when the first flushing mode is performed.

On the other hand, it is preferable that the method further comprises the step of performing the second flushing mode when the first time period is elapsed but the second time period is not elapsed. The accumulated number counting step includes the step of counting the number of ink drops ejected when the second flushing mode is performed.

In the above configurations, an amount of ink that is ejected into the capping member by the flushing operations is managed by the flushing amount counter. The capping member is filled with such an amount of ink as to cover the ink absorbing member. Since a part of ink is subsequently sucked from the ink absorbing member by the suction member, the ink absorbing member is made sufficiently moist with the ink.

Accordingly, when the nozzle formation face is sealed during a non-print time of the recording apparatus, volatilization of the ink solvent through the nozzle orifice is suppressed with the ink in the sufficiently moist ink absorbing member. As a result, the increase of a viscosity of the ink or the solidification of the ink at and around the nozzle orifices are effectively suppressed.

Further, the easy-to-solidify ink and the hard-to-solidify ink are mixed through the execution of the above-mentioned control. Therefore, solidification and accumulation of the ink in the ink absorbing member can be prevented. The waste ink is swiftly discharged by suction member.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Ink jet recording apparatus constructed according to the present invention will be described with reference to the accompanying drawings.

Figure 2:
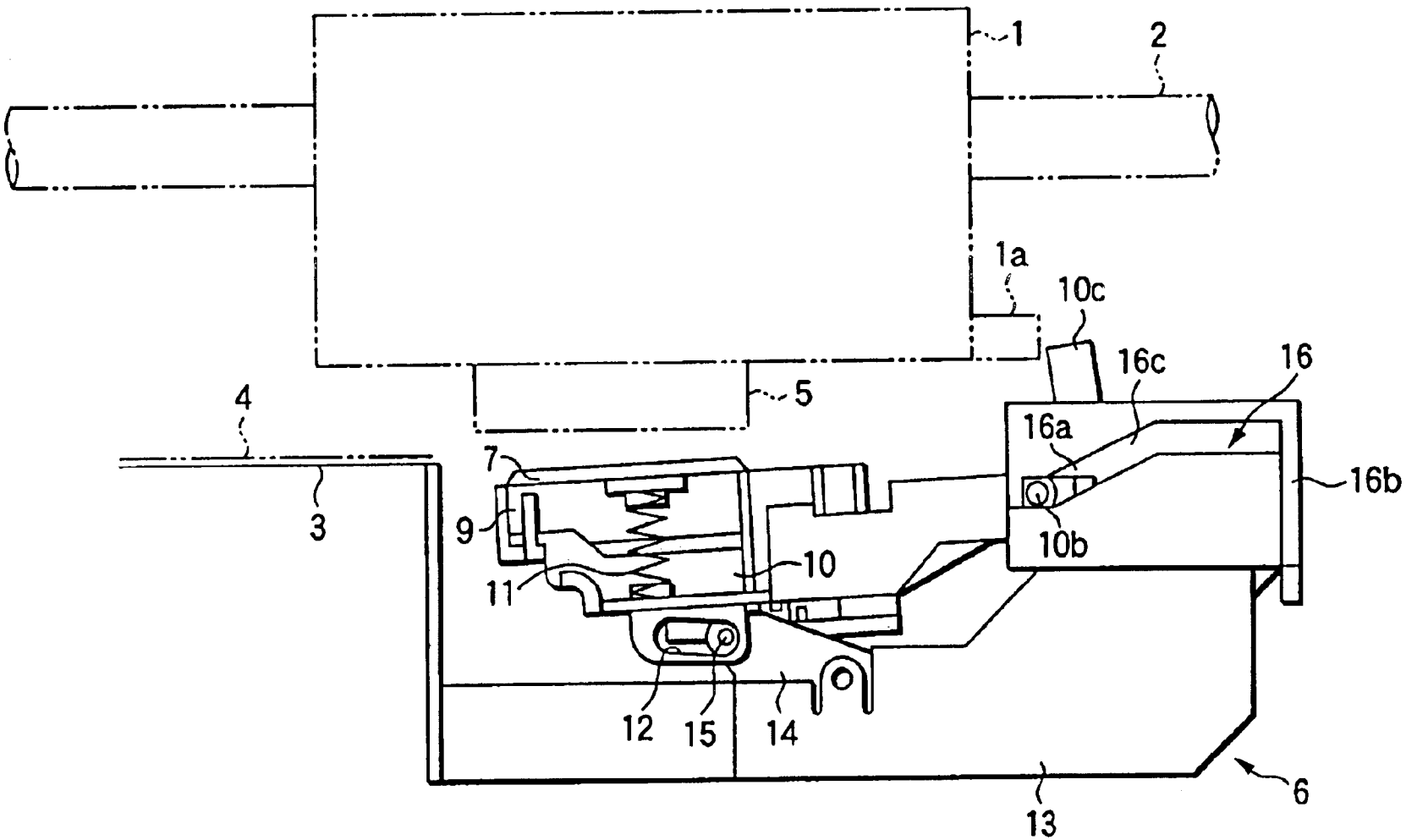
FIG. 2 is a side view showing the structure of the capping unit shown in FIG. 1.
Figure 3:
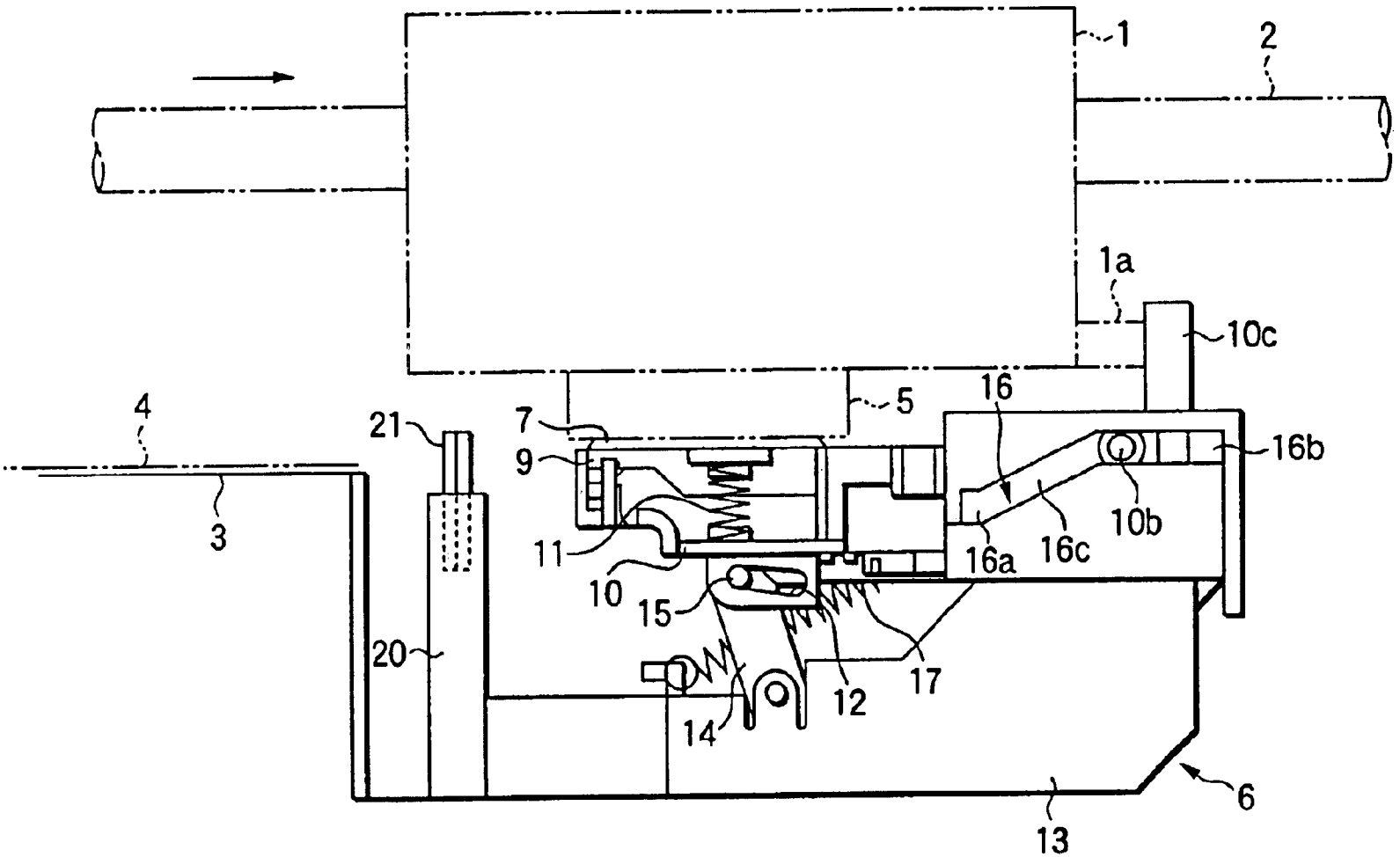
FIG. 3 is a side view showing a state that a recording head is capped with the capping unit.

Referring to FIGS. 2 and 3, a carriage 1 is guided by a guide rod 2 and moved in a longitudinal direction of a platen 3 while facing and being aligned in parallel with the same. The carriage 1 is coupled to a part of a timing belt, which is reciprocatively moved by a carriage motor to be given later, and reciprocatively moved along the guide rod 2.

The carriage 1 is mounted such that a recording head 5 faces a recording sheet 4 of paper located on an upper face of the platen 3. To print, ink is introduced into the recording head 5, and the recording head ejects ink drops onto the recording sheet 4 on the platen 3 in accordance with bit map data corresponding to print data.

A capping unit 6 capable of sealing the nozzle formation face of the recording head 5 is located in a non-print area (home position), which is formed at one end of the recording apparatus. The capping unit 6 is provided with a cap member 7 having such a size as to allow the nozzle formation face of the recording head 5 to be sealed with a sealed space located therebetween. Accordingly, the capping unit 6 has a function to prevent the ink at the nozzle orifices from being dried, and a function by sealing the nozzle formation face of the recording head 5 in a non-print mode, and another function to forcibly discharge the ink from the recording head 5 under a negative pressure generated by a suction pump (not shown) in a cleaning operation.

Further, the capping unit 6 has another function to receive the ink in a flushing operation. In operation, the capping unit 6 is selectively operable in a first flushing mode in which the recording head ejects the ink drops into the capping unit in a state shown in FIG. 3 that the nozzle formation face of the recording head 5 is sealed with the capping unit 6, or a second flushing mode in which the recording head ejects ink drops into the capping unit in a state shown in FIG. 2 that the capping unit is separated from the nozzle formation face of the recording head.

Figure 1:
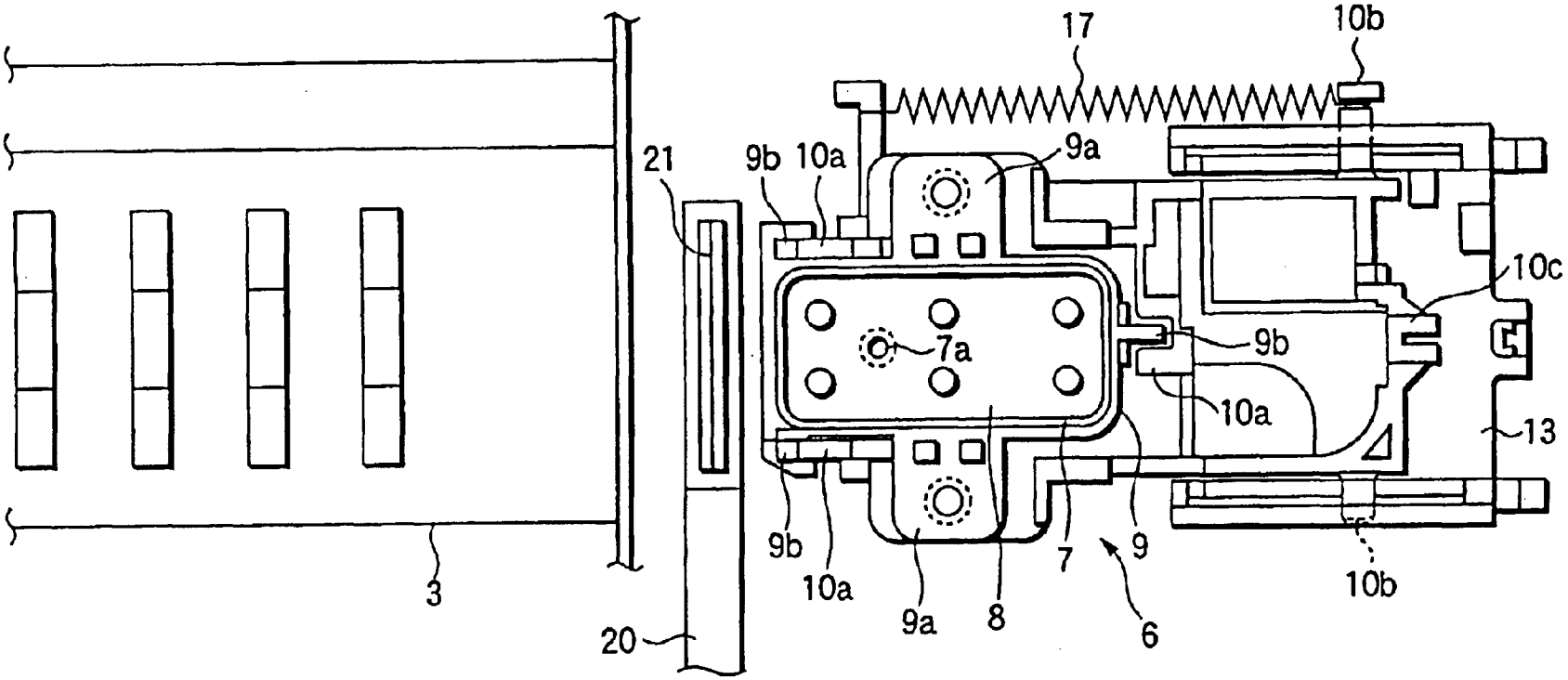
FIG. 1 is a plan view showing a structure mainly including a capping unit in an recording apparatus incorporating the present invention.

An ink outlet 7*a*, as shown in FIG. 1, is formed in the inner bottom part of the cap member 7 of the capping unit 6. The ink outlet 7*a* is connected to one end of a tube of a tube pump forming the suction pump to be described later. In a non-print mode, the nozzle formation face of the recording head 5 is sealed with the cap member 7. When receiving a cleaning command, the suction pump applies a negative pressure to the inner space of the capping unit to cause the recording head 5 to eject the ink.

As will subsequently be described, also in an idle sucking operation that is controlled when a count value of a flushing amount counter reaches a predetermined value, the suction pump to be given later is driven, so that the ink is forcibly discharged through the ink outlet 7*a* formed in the capping unit 6.

Ink absorbing member 8 shaped like a sheet is placed in the inner bottom part of the cap member 7, will be described in detail later. The ink absorbing member 8 holds the ink discharged from the recording head through the cleaning operation or the flushing operation attendant with the ejection of a large number of ink drops. The ink absorbing member 8 also catches and absorbs ink drops ejected from the recording head through the cleaning operation or the flushing operation attendant with the ejection of a small number of ink drops.

As will subsequently be described in detail, the cap member 7 and a rectangular cap holder 9 are formed in a unit form. Spring holders 9*a* are horizontally extended from both side walls of the cap holder 9 as viewed in the horizontal direction. The cap holder 9 is mounted on a slider 10 forming a lifting mechanism, and is mounted while being urged against the recording head 5 by a couple of compression springs 11, which are inserted between the slider 10 and the spring holders 9*a*.

An engaging member 9*b* is formed at the center of one end of the cap holder 9, while engaging members 9*b* are formed at both side parts of the other end of the cap holder 9. Those three engaging members 9*b* are engaged and retained at three points by retainers 10*a* of the slider 10, respectively. As a result, the cap holder 9 is mounted on the slider 10 while being prohibited from moving upward or toward the recording head 5 a predetermined distance or longer.

A couple of slots 12, while horizontally extending, are formed in the right and left parts of the lower bottom part of the slider 10. A couple of horizontal shafts 15, which are provided at the free ends of link arms 14 rotatably mounted on a frame 13, are slidably put in the slots 12, respectively. With this structure, the slider 10 may rise with respect to the frame 13 with the aid of the link arms 14, while tracing an arcuate path.

Guide pieces 10*b* are formed on both side ends of the non-print area side of the slider 10, respectively. Those guide pieces 10*b* are supported by a couple of guide grooves 16 formed in the frame 13. Each guide groove 16 consists of three parts continuous to one another; a lower flat part 16*a* located at one end, a higher flat part 16*b* located at the other end, and a slanted part 16*c* interconnecting the lower and higher flat parts.

As shown in FIG. 1, one end of the guide pieces 10*b* is connected to one end of a tension spring 17 which is fastened at the other end to the frame 13. The tension spring 17 urges the slider 10 toward the print area and in a direction in which it moves apart from the recording head 5, viz., downward in the embodiment.

When the carriage 1 is moved to a position just above the capping unit 6 as shown in FIG. 2, an engaging member la provided on the carriage 1 comes in contact with an engaging member 10*c* uprighted on the slider 10. As a result, the slider 10 is lifted with the aid of the link arms 14 while resisting a spring force of the tension spring 17. And the cap member 7 integral with the cap holder 9 sealingly closes the nozzle formation face of the recording head 5 put on the carriage 1.

When the carriage 1 moves to the print area, the engaging member 1*a* of the carriage 1 is separated from the engaging member 10*c* of the slider 10, the slider 10 is returned to a state shown in FIG. 2 by a pulling force of the tension spring 17. As a result, the sealing of the nozzle formation face of the recording head 5 with the cap member 7 is removed.

As shown in FIG. 2, the sealing face of the cap member 7, or the upper end face thereof to be brought into contact with the nozzle formation face of the recording head 5, is not parallel to the nozzle formation face of the recording head 5. In other words, the sealing face of the cap member 7 is slanted so as to somewhat lower to the print area with respect to the home position side (the right side in FIG. 2). This is realized by appropriately selecting the positions of the horizontal shafts 15 in the slots 12 formed in the slider 10 and the positions of the guide pieces 10*b* that slide in the guide grooves 16 formed in the frame 13.

When the cap member 7 sealingly closes the nozzle formation face of the recording head 5, the cap member 7 first comes in contact with the nozzle formation face, from the home position side. As the slider 10 is lifted, it sealingly closes the entire nozzle formation face of the recording head 5 by compressing force of the compression springs 11. To release the sealing of the nozzle formation face of the recording head 5, the cap member 7 is first separated from the end of the nozzle formation face which is closer to the print area, and completely separated from the nozzle formation face in a state that it is slanted with respect to the nozzle formation face.

As shown in FIG. 1 or 3, a holding member 20 with a wiping member 21 made of rubber or the like is provided at a position which is adjacent to the capping unit 6 and closer to the print area. The wiping member 21 is used for wiping out the nozzle formation face of the recording head 5 carried by the carriage 1. The wiping operation is performed in cooperation with the movement of the carriage 1. The holding member 20 is horizontally moved and carries the wiping member to and from a wiping position on the traveling path of the recording head 5.

When the cleaning operation is started, the wiping member wipes out dust, paper powder and the like from the nozzle formation face of the recording head 5 before the ink ejecting and absorbing operations, and wipes out the ink left on the nozzle formation face after the ink ejecting and absorbing operations.

In the recording apparatus thus constructed, when the carriage motor is driven to move the carriage 1 to the home position, the engaging member 1*a* of the carriage 1, as shown in FIG. 2, is brought into contact with the engaging member 10*c* of the slider 10. Then, the carriage 1 further moves in the same direction, and at the same time the slider 10 rises with the aid of the link arms 14 while resisting the pulling force of the tension spring 17 (FIG. 3).

On the other hand, the guide piece 10*b* of the slider 10 move within and along the guide grooves 16 from the lower flat part 16*a* and the slanted part 16*c*, and then to the higher flat part 16*b*. As a result, the cap member 7 that is integral with the cap holder 9 hermetically closes the recording head 5 carried by the carriage 1.

When the sealing of the nozzle formation face with the cap member 7 is completed, the cap member 7 is disconnected in its communication with the atmosphere and put in a hermetic state. In this state, it suppresses evaporation of the ink through the nozzle orifices, and prevents the clogging of the recording head. In this state, a flushing operation is executed, and then the ink drops idly ejected from the recording head are captured with the sheet-like ink absorbing member 8 placed in the inner bottom part of the cap member 7. Further, in this state the suction pump is driven, and a negative pressure is applied to the inner space of the cap member 7. Then, the ink is discharged through the nozzle orifices of the recording head.

When the carriage motor is driven and the carriage 1 is moved to the print area side, the engaging member 1*a* of the carriage 1 leaves the engaging member 10*c* of the slider 10. Accordingly, the slider 10 is lowered through the motion of the link arms 14 and with the movement of the guide pieces 10*b* of the slider 10 to the lower flat part 16*a*. As a result, the sealing of the recording head 5 by the cap member 7 is released.

When the sealing of the nozzle formation face of the recording head by the cap member 7 is released, the cap member 7 is first separated from the end of the nozzle formation face which is closer to the print area, and completely separated from the nozzle formation face in a state that it is slanted with respect to the nozzle formation face. Thus, the cap member 7 is separated from the nozzle formation face of the recording head 5 in a state that it is slanted with respect to the nozzle formation face.

The waste ink which will stay on the nozzle formation face of the recording head receives a force to pull it back to the waste ink stored in the cap member 7. With this force, an amount of ink left on the nozzle formation face is reduced to a minimum. The operation of removing the sealing of the nozzle formation face of the recording head 5 by the cap member 7 starts at one end thereof. This feature suppresses the unnecessary bubbling of the waste ink stored in the cap member 7.

Figure 4:
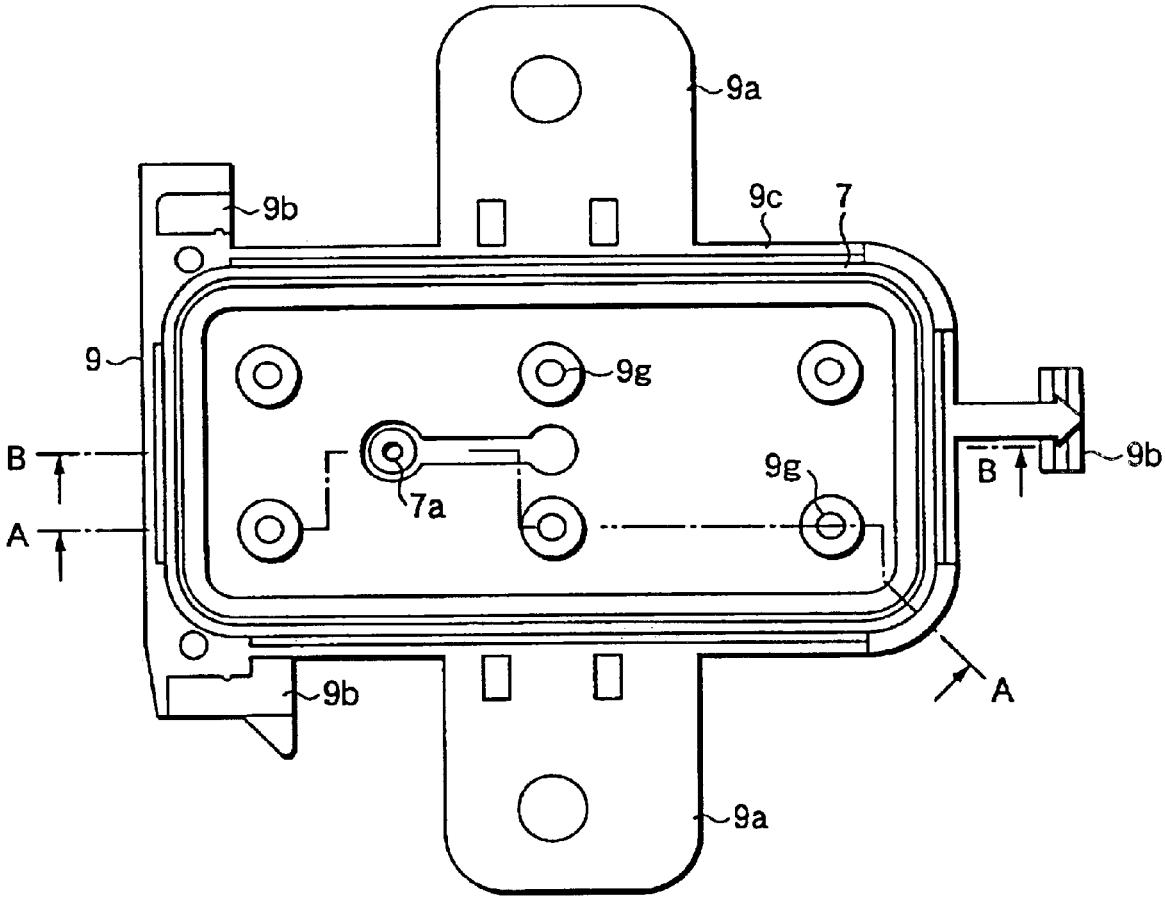
FIG. 4 is a plan view showing a structure in which a cap member is molded onto a cap holder forming the capping unit.
Figure 5:
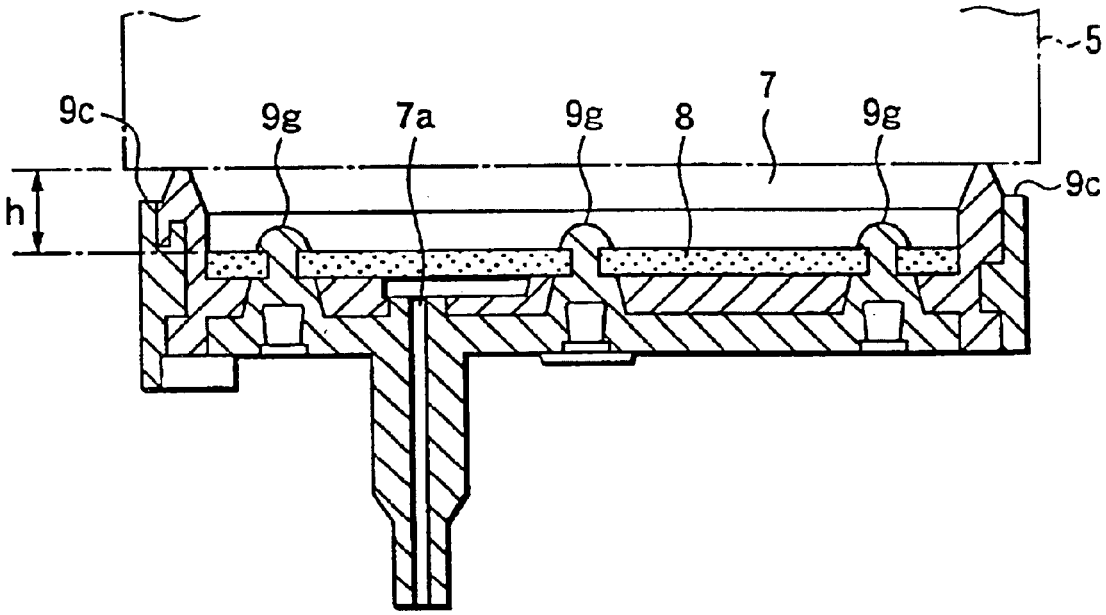
FIG. 5 is a cross sectional view taken on a line A—A in FIG. 4 when viewed in the direction of arrows.

FIG. 4 is a plan view showing a structure including the cap holder 9 and the cap member 7, which form the capping unit. FIG. 5 is a cross sectional view taken on line A—A in FIG. 4 when viewed in the direction of arrows. In FIGS. 4 and 5, like or equivalent portions in FIGS. 1 to 3 are designated by like reference numerals.

As shown in FIG. 4, the cap holder 9 is made of hard synthetic resin and takes a rectangular shape whose upper part is opened. Its opening end face 9*c* is substantially flush with the upper face of the paired spring holders 9*a* which horizontally extend. The opening end face 9*c* is annularly formed along the outer circumference of the cap holder 9. Rib members 9*g* like cylindrical poles uprighted on the inner bottom part of the cap holder 9. Those rib members 9*g* are integral with the cap holder 9. The tips of the rib members 9*g* are crushed by a heat-clamping, and the sheet-like ink absorbing member 8 is held on the inner bottom part by the rib members 9*g*.

As shown in FIG. 5, the cap member 7 made of a soft material, e.g., elastomer, is integrally formed with the cap holder 9 within the cap holder 9 by a two-color molding process. In the molding, the upper edge of the cap member 7 is triangular in cross section, and protruded above the opening end face 9*c* of the cap holder 9. The upper edge of the cap member 7 thus configured serves as a sealing part against the nozzle formation face of the recording head. Accordingly, a degree of close contact is increased at the sealing part and the inner space in the capping unit is kept in a good sealing state.

With such a structure, when the nozzle formation face of the recording head 5 is sealed by the capping unit, a predetermined gap "h" is formed between the nozzle formation face of the recording head 5 and the face of the ink absorbing member 8. In the embodiment, the gap "h" is approximately 3 mm. With presence of the gap "h", when bubbles are generated in the waste ink discharged into the capping unit, the bubbles attach to the nozzle formation face of the recording head, thereby lessening a degree of destruction of the meniscuses of ink formed at the nozzle orifices.

Figure 6:
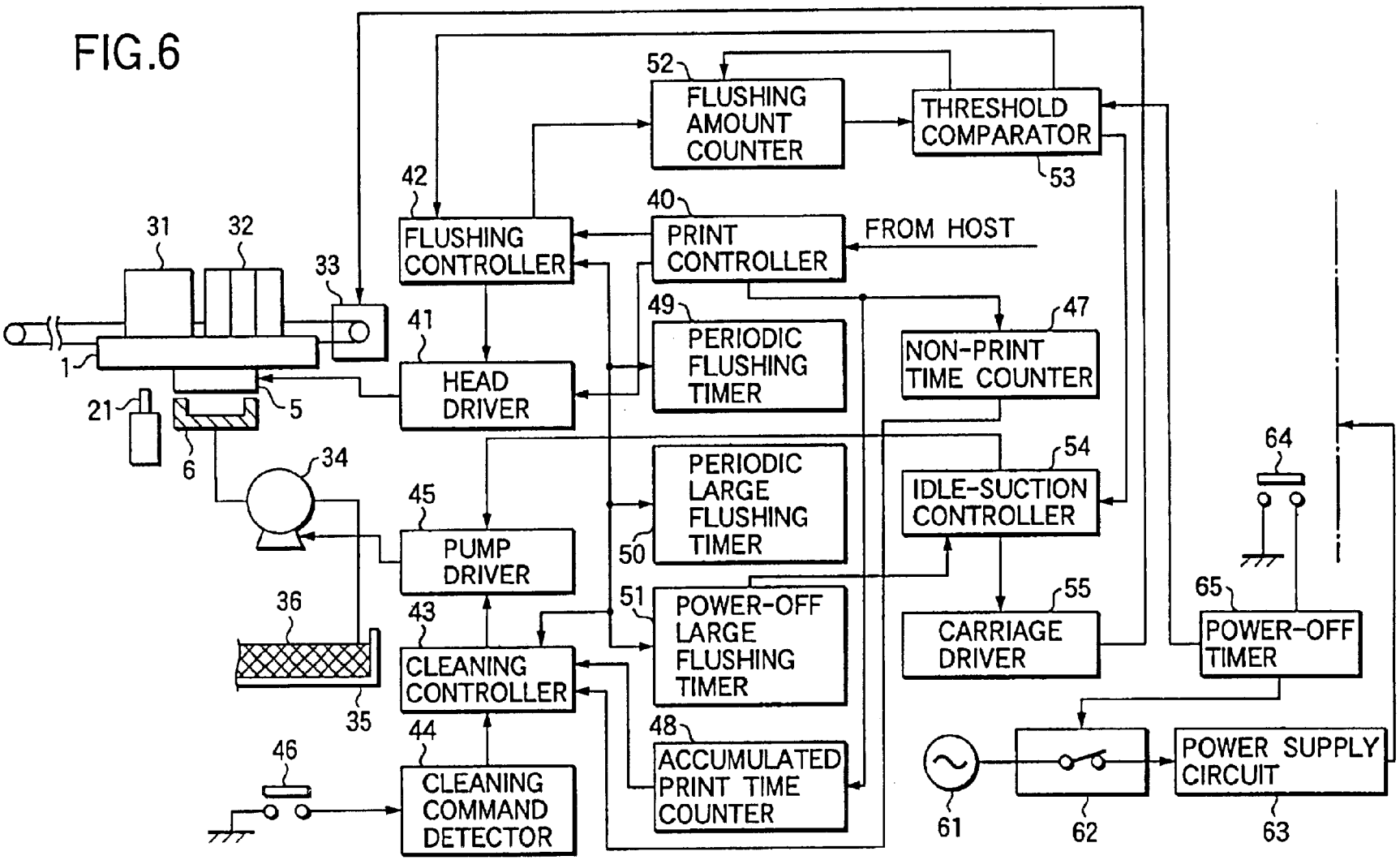
FIG. 6 is a block diagram showing an arrangement of a control circuit for controlling the flushing operations and others, which is mounted on the recording head.

FIG. 6 shows an arrangement of a control circuit for controlling the flushing operations and others by using the capping unit constructed as mentioned above. In FIG. 6, like or equivalent portions are designated by like reference numerals, for simplicity. As shown in FIG. 6, a black ink cartridge 31 and a color ink cartridge 32 are detachably mounted on the carriage 1. Inks are supplied from the cartridges to the recording head 5. The carriage 1 receives a drive force from a carriage motor 33, and is reciprocatively moved in the longitudinal direction of the guide rod 2, or in the main scanning direction.

A discharge side of a tube pump 34 as the suction pump capable of sucking the inner space of the capping unit 6 to generate a negative pressure therein is connected to a waste ink tank 35. The waste ink discharged from the suction pump 34 is absorbed by and retained in a waste ink absorbing member 36 placed in the waste ink tank 35.

In FIG. 6, a print controller 40 receives print data from a host computer, and generates dot pattern data (bit map data). Upon receipt of the bit map data, a head driver 41 generates a drive signal, and the recording head 5 ejects ink drops.

In addition to the drive signal based on the print data, the head driver 41 receives a flushing command signal from a flushing controller 42 and outputs a drive signal for the flushing operation to the recording head 5, so that it performs an idle ejection of ink drops, which is irrelevant to the print. A cleaning controller 43 receives a control signal from a cleaning command detector 44, for example, and controls a pump driver 45 to drive a suction pump 34.

A cleaning command switch 46 is located on an operation panel of the recording apparatus. When a user finds printing failure, for example, he operates this switch and operates the cleaning controller 43 through the cleaning command detector 44, whereby a cleaning operation based on a manual operation is performed.

The print controller 40 sends a control signal to a non-print time counter 47 and an accumulated print time counter 48. The non-print time counter 47 is reset to zero when the printing operation is terminated, and immediately starts its operation to count up an elapsing time. Thus, the non-print time counter 47 has a function to count a time period that the recording head is capped after the end of the printing.

The accumulated print time counter 48 counts an accumulative print time when the printing is performed. When the cleaning controller 43 executes the cleaning operation, it receives a reset signal. Upon receipt of a reset signal from the cleaning controller 43, the accumulated print time counter 48 is reset to zero, and counts up an accumulated print time period in accordance with a control signal from the print controller 40. Thus, the accumulated print time counter 48 counts an accumulated time period that the recording head 5 prints in a state that it is not capped by the capping unit 6.

When a power source for the recording apparatus is turned on, the cleaning operation or the flushing operation are executed in accordance with time count data provided from the non-print time counter 47 and the accumulated print time counter 48 while referring to a recovery operation selecting table (not shown) which directs which operation is performed in accordance with the elapsing time period. In FIG. 6, the non-print time counter 47 and the accumulated print time counter 48 output control signals to the cleaning controller 43. A control signal is output also to the flushing controller 42 based on the signals outputted from the respective timers.

Control signals based on the time count data, which are produced by a periodic flushing timer 49, a periodic large flushing timer 50, and a power-off large flushing timer 51, are transmitted to the large flushing controller 42. The periodic flushing timer 49 has a function to count a first time period (e.g., 10 seconds) during printing or standby. When the first time period exceeds 10 seconds, a control signal is transmitted to the large flushing controller 42, thereby causing it to execute the periodic flushing operation. The periodic flushing timer 49 is used for discharging ink of an increased viscosity at the nozzles not used during printing (the nozzles having no or less chance of ejecting ink drops).

In this case, different kinds (colors) of inks have their own degrees of viscosity increases. Accordingly, in the periodic flushing operation in the recording apparatus using six color inks, the numbers of ejected ink drops are selected as shown in Table 1. In the table, Y is a yellow ink, K is a black ink, C is a cyan ink, LC is a light cyan ink, and M is a magenta ink, LM is a light magenta ink.

TABLE 1

| K | C | LC | M | LM | Y |
|---|---|---|---|---|---|
| 96 | 72 | 72 | 72 | 72 | 72 |

When the recording apparatus prints for a second time period (e.g., 2000 seconds), the periodic large flushing timer 50 outputs a control signal to the large flushing controller 42 to direct the flushing controller 42 to carry out a control for a large flushing operation. This periodic large flushing operation is performed during printing or discharging of the recording sheet. The periodic large flushing timer 50 is also used for discharging ink of increased viscosity from the nozzles not used during printing. In the periodic large flushing operation, the number of ink drops ejected for flushing is controlled to as to be increased much greater than that in the periodic flushing operation.

TABLE 2

| K | C | LC | M | LM | Y |
|---|---|---|---|---|---|
| 40000 | 20000 | 20000 | 20000 | 20000 | 20000 |

When the power source for the recording apparatus is turned off, the power-off large flushing timer 51 counts an elapsing time from the previous turning-off of the power source. The power-off large flushing timer 51 sends a control signal based on the elapsing time to the large flushing controller 42 so that the power-off large flushing operation is executed and the power source for the recording apparatus is subsequently turned off as will be described later.

The power-off large flushing operation is executed for making the inside of the capping unit retain moisture. During a non-print period of the recording apparatus, volatilization of the ink solvent from the nozzle orifices is suppressed. The number of ink drops ejected at this time are as shown in Table 3.

TABLE 3

| K | C | LC | M | LM | Y |
|---|---|---|---|---|---|
| 50000 | 30000 | 20000 | 30000 | 20000 | 20000 |

In FIG. 6, data indicative of the number of ink drops for flushing is transferred from the large flushing controller 42 to a flushing amount counter 52. The flushing amount counter 52 additively counts up the number of ink drops for flushing, which are ejected in the periodic flushing operation, the periodic large flushing operation, and the power-off large flushing operation. The flushing amount counter 52 transfers count-up data to a threshold comparator 53.

The threshold comparator 53 judges whether or not the count-up data transferred to the flushing amount counter 52 reaches a predetermined value stored in the threshold comparator 53. When the judgment result is that the count-up date reaches the predetermined threshold value, a control signal is sent to an idle-suction controller 54. At the same time, a reset signal is sent from the threshold comparator 53 to the flushing amount counter 52. Upon receipt of the reset signal, the flushing amount counter 52 containing the count-up data is reset to zero.

The predetermined value stored in the threshold comparator 53 is selected to provide such an amount of ink ejected into the capping unit 6 by the flushing operation as to cover the ink absorbing member 8 located on the inner bottom part of the capping unit 6.

The idle-suction controller 54 sends a control signal to a carriage controller 55. In turn, the carriage controller 55 drives the carriage motor 33. By the driving of the carriage motor 33, the carriage 1 is somewhat moved to the print area side, and the capping unit 6 which is sealing the nozzle formation face of the recording head 5 releases the sealing of the nozzle formation face.

A control signal is sent from the idle-suction controller 54 to the pump driver 45. In a state that the sealing of the nozzle formation face is removed by the capping unit 6 is removed, the suction pump 34 is driven for a predetermined time. Then, the idle-suction operation for discharging part of the ink from the capping unit 6 is performed. Accordingly, the ink absorbing member 8 placed in the inner bottom part of the capping unit 6 retains a sufficient amount of the absorbed ink. Therefore, an accumulation of the easy-to-solidify ink on the ink absorbing member 8 is suppressed, and as a result, such a problem that the ink discharging trouble caused by the accumulated ink during the cleaning operation is avoided.

In the recording apparatus of the embodiment, when the power source for the recording apparatus is turned off, the power-off flushing operation is performed. Accordingly, the power source is actually turned off after a predetermined time elapses from the turn-off instruction. As shown in FIG. 6, a commercial AC power source 61 supplies electric power to a power supply circuit 63 for generating a DC power source used for the recording apparatus by way of a power switch 62 formed with a relay switch.

A power-off timer 65 is driven by a power control switch 64 located on the operation panel of the recording apparatus. After a predetermined time elapses, the power-off timer 65 turns off the power switch 62 formed with the relay switch. Accordingly, after a predetermined time period set by the power-off timer 65 elapses, in other words, after the power-off flushing operation is performed, the power switch 62 is turned off.

Figure 7:
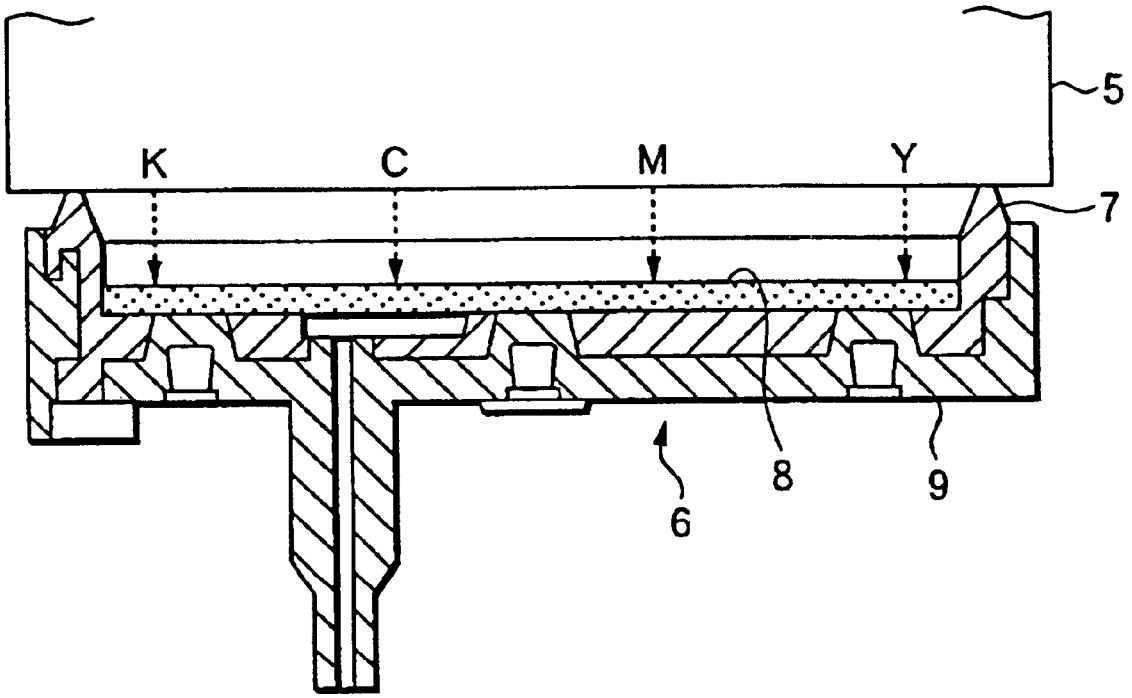
FIG. 7 is a cross sectional view showing a structure including mainly the capping unit and the recording head when a first flushing mode is executed in a state that the nozzle formation face of the recording head is sealed with the capping unit.
Figure 8:
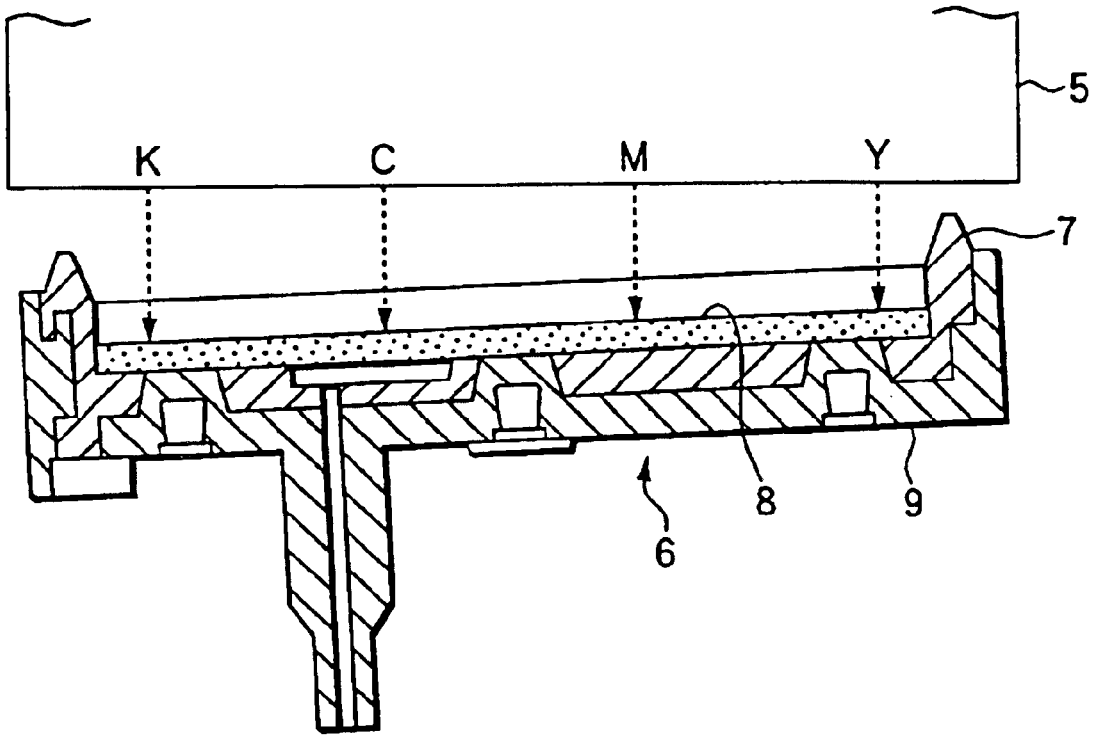
FIG. 8 is a cross sectional view showing the structure when a second flushing mode is executed in a state that the nozzle formation face of the recording head is separated from the capping unit.
Figure 9:
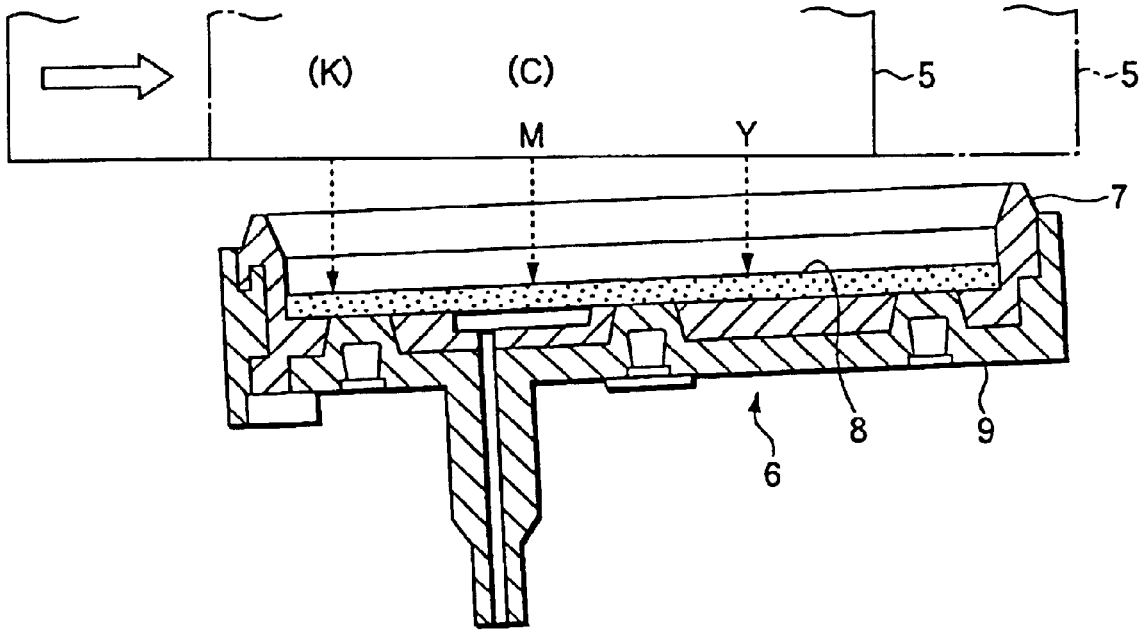
FIG. 9 is a cross sectional view showing the structure when different kinds of ink drops are ejected to substantially the same position within the cap member.

FIGS. 7 through 9 show the respective flushing operations performed by the recording apparatus constructed as mentioned above. The capping unit 6 are illustrated while being taken on a line B—B and viewed in the direction of arrows in FIG. 4. In FIG. 7, the nozzle formation face of the recording head is sealed with the capping unit, and in this state, a first flushing mode is executed in which ink drops are ejected from the recording head into the capping unit.

In FIG. 8, the nozzle formation face of the recording head is separated from the capping unit, and in this state, a second flushing mode is executed in which ink drops are ejected from the recording head into the capping unit. In FIG. 9, the ink drop ejection in the second flushing mode is controlled so that different kinds of ink drops are ejected to substantially the same position on the ink absorbing member within the capping unit.

Those flushing operations shown in FIGS. 7 to 9 may be realized by a moving position of the carriage 1 constructed as shown in FIGS. 1 to 3 and timings at which drive signals are applied to the actuators provided in association with the nozzle arrays of the recording head. In a first flushing mode shown in FIG. 7, as shown in FIG. 3, the slider 10 is raised through the motion of the link arms 14, and the guide pieces 10*b* of the slider 10 are moved to the upper flat parts 16*b* of the guide grooves 16. As a result, the nozzle formation face of the recording head 5 is sealed with the cap member 7.

The first flushing mode is suitably used for in performing the periodic large flushing operation which ejects a relatively large number of ink drops, and the power-off flushing operation. In the illustration of FIG. 7, ink drops of colors K, C, M, and Y are ejected. However, in the embodiment, ink drops of other colors LC and LM are also ejected although not illustrated. The number of ink drops ejected in the periodic large flushing operation and the power-off flushing operation are also shown in Table 2 or 3.

In the first flushing mode, ink drops ejected from the recording head 5 bounce off the face of the ink absorbing member 8, and return to the nozzle orifices of the recording head 5. As a result, the different color inks are mixed into a mixed color. However, the generation of the mixed color is lessened since the predetermined gap "h" (3 mm in the embodiment), as shown in FIG. 5, is present between the nozzle formation face of the recording head 5 and the surface of the ink absorbing member 8. There is less chance that the meniscuses formed at the nozzle orifices by the bounced ink drops and other troubles occur.

The flushing operation of the first flushing mode is performed in a state that the nozzle formation face of the recording head 5 is sealed with the capping unit 6. Accordingly, even when ink mist is generated in the space sealed, there is no chance that the ink mist is leaked outside, and most of the ink mist falls on the surface of the ink absorbing member 8 and captured by the same. Therefore, when the sealing of the recording head 5 by the capping unit 6 is removed, an amount of ink mist floating to outside is considerably reduced.

In the second flushing mode shown in FIG. 8, as shown in FIG. 4, the slider 10 descends through the motion of the link arms 14, while at the same time the guide pieces 10*b* of the slider 10 moves to the lower flat part 16*a* of the guide grooves 16. As a result, sealing of the nozzle formation face of the recording head 5 by the capping unit 6 is released.

The second flushing mode is suitably used for in performing the periodic flushing operation which ejects a relatively small number of ink drops. In the illustration of FIG. 8, ink drops of colors K, C, M, and Y are ejected as in FIG. 7. However, in the embodiment, ink drops of other colors LC and LM are also ejected although not illustrated. The numerical values tabulated in Table 1 are used for the number of ink drops ejected in the periodic flushing operation.

In the second flushing mode, ink drop ejecting operation is controlled such that a distance between the nozzle formation face of the recording head and the ink absorbing member located in the capping unit is varied in accordance with a kind of ink. Specifically, the carriage 1 is somewhat moved to the right from a state shown in FIG. 9, and the engaging member 1*a* of the carriage 1 is brought into contact with the engaging member 10*c* of the slider 10. Then, the slider 10 is somewhat raised through the motion of the link arms 14.

The guide pieces 10*b* of the slider 10 is moved to the slanted part 16*c* of the guide grooves 16. As a result, a distance between the nozzle formation face of the recording head and the ink absorbing member disposed within the capping unit, is reduced. Thus, the distance between the nozzle formation face and the ink absorbing member in the capping unit is varied with the movement of the carriage 1 to the right, shown in FIG. 9.

In the second flushing mode, e.g., the periodic flushing operation using the magenta or cyan ink which is easy to cause the ink mist, it is preferable to reduce the distance between the nozzle formation face and the ink absorbing member in the capping unit. With this, there is less chance of generating the ink mist.

When the second flushing mode is used, if ink to be ejected from the recording head, as shown in FIG. 9, is selected in accordance with a moving position of the recording head, different kinds of ink drops are ejected to substantially the same position of the ink absorbing member located in the capping unit. Specifically, at a moving position of the recording head 5, indicated by a solid line in FIG. 9, ink drops of M and Y colors are ejected for flushing, and then the recording head 5 is moved to a position indicated a phantom line. At this position, the ink drops of K and C colors are ejected for flushing.

Where the controller for executing the controls mentioned above is employed, the cyan (C) ink hard to solidify is ejected to a flushing position of the magenta (M) ink easy to solidify. As a result, there is no chance that the magenta ink is solidified and accumulated on the ink absorbing member. When a relatively small number of ink drops are intermittently ejected to the same position of the ink absorbing member, as in the periodic flushing operation, the solidification and accumulation of the magenta ink are remarkable in degree and amount. In this case, this problem is avoided by operating the controller mentioned above, however.

Figure 10:
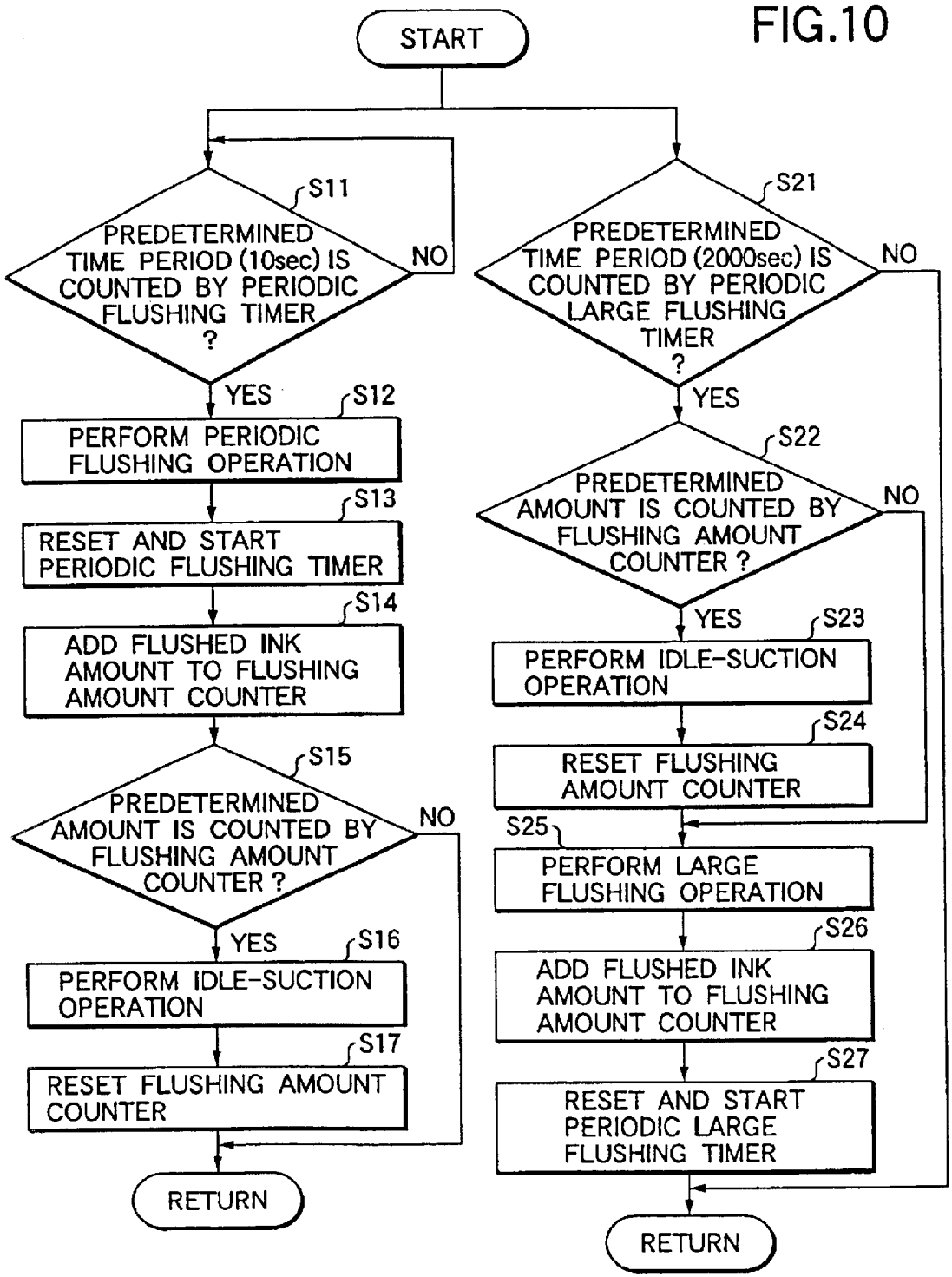
FIG. 10 is a flow chart showing a control sequence of a periodic flushing operation and a periodic large flushing operation.
Figure 11:
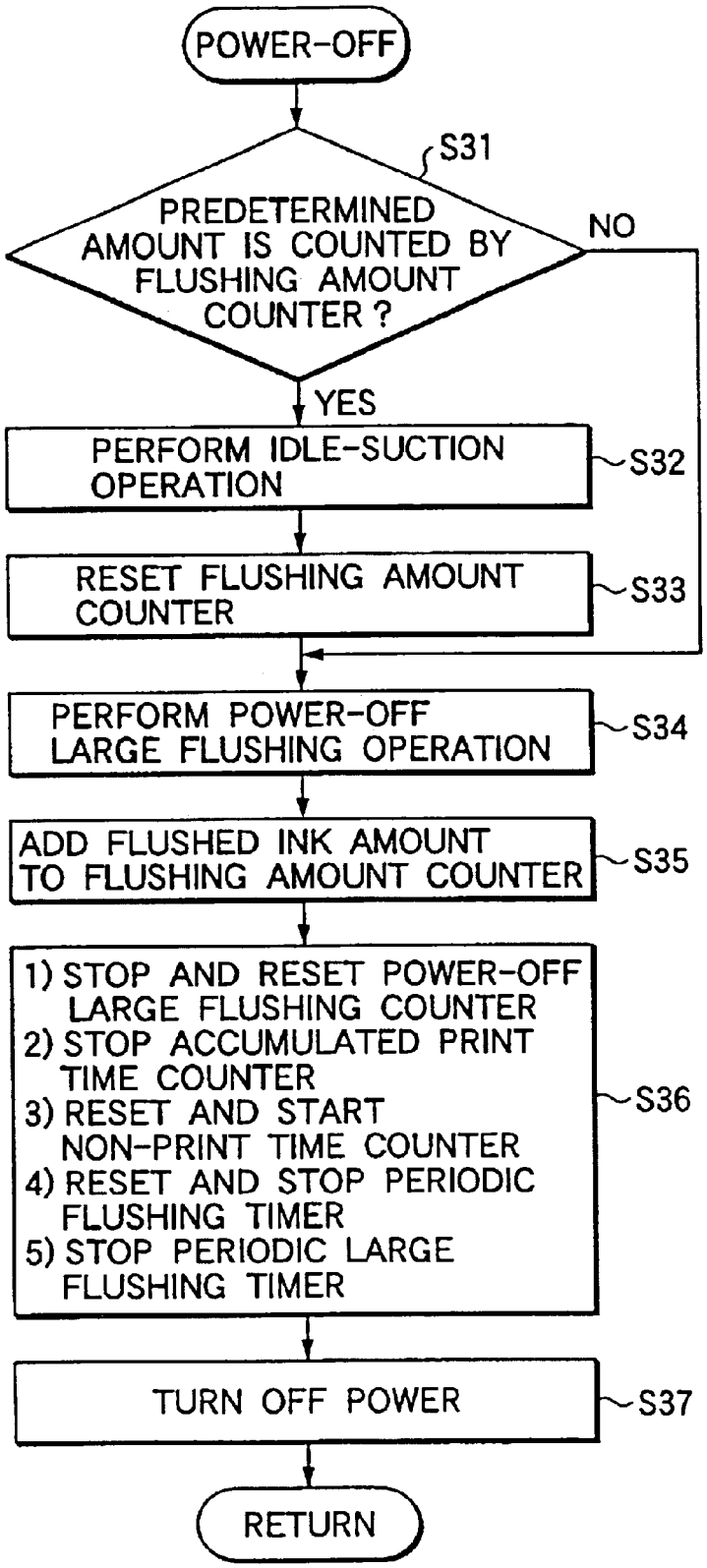
FIG. 11 is a flow chart showing a control sequence of a power-off flushing operation when the power source of the recording apparatus is turned off.
Figure 12:
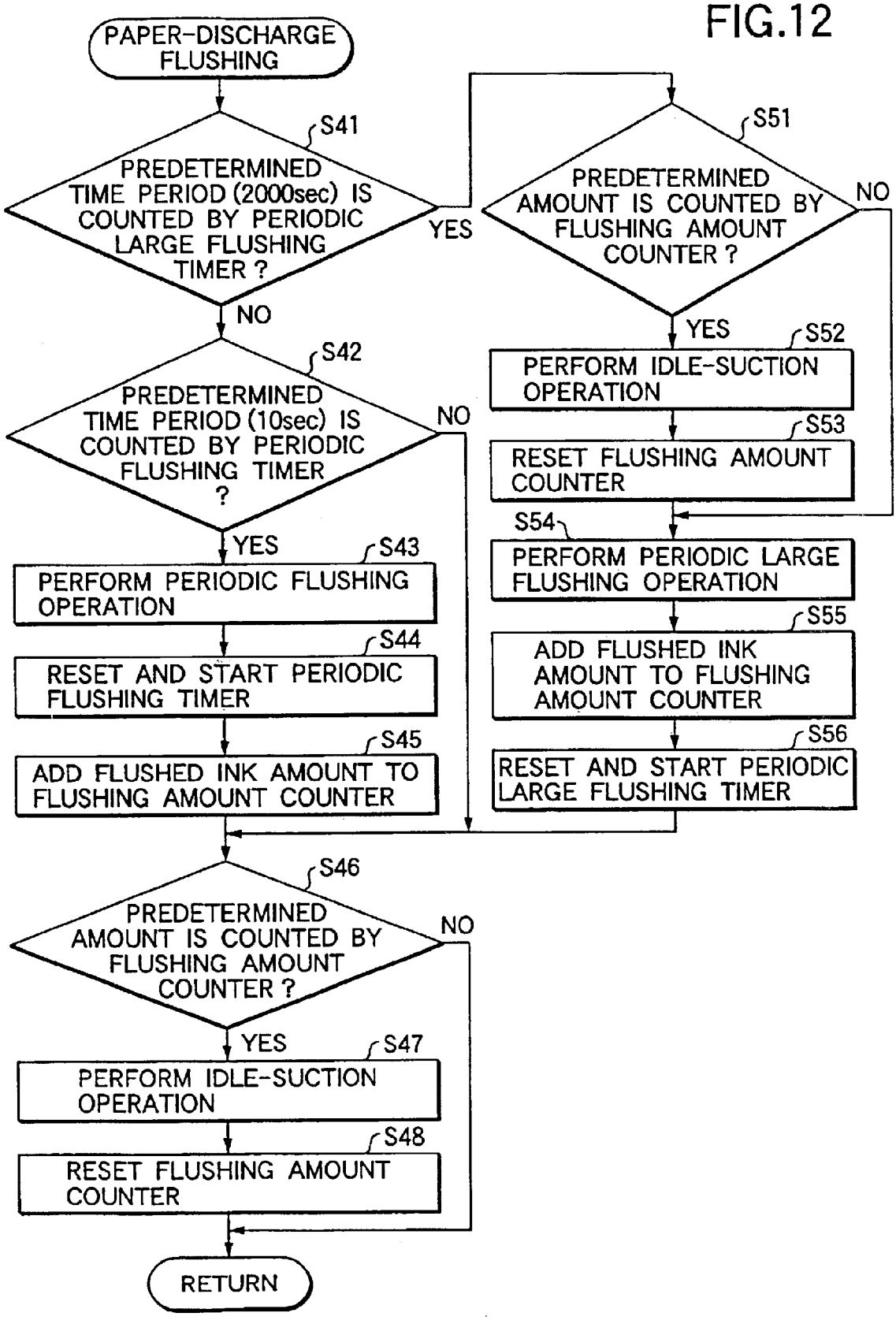
FIG. 12 is a flow chart showing a control sequence of a paper-discharge flushing operation executed when a recording sheet of paper is discharged.

FIGS. 10 to 12 are flow charts useful in explaining flushing controls carried out by the recording apparatus thus constructed. Those controls are carried out mainly for preventing specific inks from solidifying by causing the ink absorbing member placed in the inner bottom part of the capping unit to retain a sufficient amount of ink. Controls flows shown in FIGS. 10 to 12 will be described by using the block diagram shown in FIG. 6.

FIG. 10 shows a control flow for the periodic flushing operation and the periodic large flushing operation. In FIG. 10, a step S11 judges if the periodic flushing timer counts a predetermined time (10 seconds). When it counts the predetermined time (the answer is Yes), the control advances to a step S12, and the periodic flushing operation is performed. This flushing operation is performed when the periodic flushing timer 49 sends a control signal to the large flushing controller 42 (FIG. 6). At this time, the number of shots by ink drops is controlled as shown in Table 1.

In a step S13, a count of the periodic flushing timer 49 is reset to zero, and the timer is started in operation. Subsequently, as in a step S14, the number of ink drops ejected by the periodic flushing is added to the contents of the flushing amount counter 52. The adding operation is performed in a manner that data indicative of the number of ink shots is sent from the large flushing controller 42 to the flushing amount counter 52 (FIG. 6). A step S15 checks if a count (accumulation value) of the flushing amount counter 52 reaches a predetermined value.

This check is made in a manner that a count value of the flushing amount counter 52 is sent therefrom to the threshold comparator 53. Specifically, a predetermined number of ink shots (e.g., 60000 shots) is stored in the threshold comparator 53. If the count value of the flushing amount counter 52 does not yet reaches the predetermined number of shots (the answer is No), the control returns to the start of the program. When the count value of the flushing amount counter 52 reaches the predetermined value (the answer is Yes) in the step S15, the control advances to a step S16, and the idle-suction operation is performed.

To perform the idle-suction operation, the threshold comparator 53 sends a control signal to the idle-suction controller 54. In turn, the idle-suction controller 54 sends a control signal to the carriage controller 55. As a result, the carriage 1 is somewhat moved toward the print area, and the capping unit 6 which has sealed the nozzle formation face of the recording head 5 release its sealing. And the idle-suction controller 54 sends a control signal to the pump driver 45, which in turn drives the suction pump 34 for a predetermined time.

Part of the waste ink stored in the capping unit 6 is cast into the waste ink tank 35 via the suction pump 34, and the ink absorbing member 8 placed in the inner bottom part of the capping unit 6 is sufficiently moistened with the ink. Accordingly, the specific ink has to solidify is not accumulated in the ink absorbing member 8.

A step S21 judges if the periodic large timer 50 has counted a predetermined time (2000 seconds). If it does not count the predetermined time (No), the control returns to the start of the program. When the periodic large timer 50 has counted the predetermined time (Yes), the control advances to a step S22. This step checks if a count value of the flushing amount counter 52 reaches a predetermined value (accumulation value). The check function of this step S22 resembles that in the step S15.

In the step S22, when the count value of the flushing amount counter 52 reaches the predetermined value (Yes), steps S23 and S24 are successively executed. In this case, the steps S23 and S24 resemble the steps S16 and S17. Then, the subsequent step S25 is executed; the periodic large flushing operation is performed. Also when the count value of the flushing amount counter 52 does not reach the predetermined value (No), the step S25 is executed, and the periodic large flushing operation is performed.

The periodic large flushing operation in the step S25 is performed in a manner that the threshold comparator 53 sends a control signal to the large flushing controller 42 (FIG. 6). At this time, the numbers of ink drops ejected from the nozzle orifices are selected as shown in Table 2. The number of ink shots in the step S25 is added to the count value in a step S26. This addition is made in a manner that the large flushing controller 42 sends data indicative of the number of ink shots to the flushing amount counter 52 (FIG. 6). And in a step S27, the periodic large timer 50 is reset to zero and started in its operation.

FIG. 11 is a flow chart showing a control sequence of the power-off flushing operation performed when the power source for the recording apparatus is turned off. When the power control switch 64 shown in FIG. 6 is operated, then the power-off timer 65 is started. At this time, the power-off timer 65 outputs a control signal to the threshold comparator 53, and as shown a step S31 is executed to judge whether or not a count value of the flushing amount counter 52 reaches a predetermined value. Steps S32 and S33, which follows the step S31, resemble the steps S15 to S17, and the steps S22 to S24 in FIG. 10.

In a step S34, the power-off large flushing operation is performed. At this time, the number of ink drops ejected from the nozzle orifices are controlled so as to satisfy those in Table 3. Subsequently, the number of ink shots in the step S34 is added to the count value in a step S35. The addition is made in a manner that data indicative of the number of ink shots is sent from the large flushing controller 42 to the flushing amount counter 52. In a step S36, the respective times are drive controlled.

Specifically, in the step S36, the power-off large timer 51 is reset to zero. The accumulated print time counter 48 is stopped. The non-print time counter 47 is reset to zero and then started. The periodic flushing timer 49 is reset to zero, and stopped in its operation. The periodic large timer 50 is stopped. In this way, those timers are drive controlled, and then a step S37 is executed to turn off the power source. The power-off operation is performed in a manner that a control signal, which is generated when the power-off timer 65 counts a predetermined time period, opens the power switch 62 formed with the relay switch.

FIG. 12 is a flow chart showing a control sequence of a paper-discharge flushing operation executed when a recording sheet of paper is discharged. In the paper-discharge flushing operation, a step S41 judges whether or not the power-off large timer 51 has counted a predetermined time (2000 seconds). When the answer is No (not yet counted), a step S42 is executed to judge whether or not the periodic flushing timer 49 has counted a predetermined time (10 seconds). If the answer is Yes (counted), steps S43 to S45 are executed. In the steps S43 to S45, a control sequence similar to that in the steps S12 to S14 already described is executed, and a step S46 is then executed.

In the step S42, if it is judged that the periodic flushing timer 49 does not yet count the predetermined time (No), the control directly advances to the step S46. Then, steps S46 to S48 are executed. In the steps S46 to S48, a control sequence similar to that in the steps S15 to S17 already described in FIG. 10 is executed.

When the step S41 judges that the power-off large timer 51 has counted the predetermined time period (Yes), the control advances to a step S51. This step S51 checks if a count value of the flushing amount counter 52 reaches a predetermined threshold value. A control sequence executed in the steps S51 to S56 resembles that executed in the steps S22 to S27 already described referring to FIG. 10. After the execution of the step S56, the steps subsequent to the step S46 are executed.

As described above, in the control sequences shown in FIGS. 10 to 12, as shown in the steps S15, S22, S31, S46 and S51, check is made as to whether or not the accumulation value in the flushing amount counter 52 reaches a predetermined value. If it reaches the predetermined value, the idle-suction operation is executed. Accordingly, the idle-suction operation is performed in a state that a sufficient amount of ink, controlled by the flushing amount counter 52, is stored in the ink absorbing member 8 put in the inner bottom part of the capping unit 6. With this, the problem that the specific ink solidifies and is accumulated on the ink absorbing member 8 is avoided.

In the periodic large flushing operation in the above-mentioned embodiment, the numbers of ink drops ejected are controlled so as to satisfy Table 2. In this flushing operation, the numbers of ink drops ejected may be controlled in accordance with the contents in Table 4. In Table 4, "T" is an elapsing time (seconds) by the periodic large timer 50.

TABLE 4

| T | T ≦ 2000 sec | T > 2000 sec |
|---|---|---|
| shot amount | 25T | 50000 |

The numbers of ink drops ejected in the power-off large flushing operation may be set uniformly at 50000 shots. In this case, there is no need to provide the power-off large timer 51. Also in this case, the power-off large timer 51 controlled in the step S36 shown in FIG. 11 is stopped and reset to zero.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus, comprising:

an ink jet recording head provided with a nozzle formation face on which nozzle orifices for ejecting ink drops in accordance with print data are formed;

a capping member, which seals the nozzle formation face, the capping member having an inner space formed with a bottom;

an ink absorbing member, provided on the bottom of the inner space in the capping member, and a flushing controller, which selectively performs either a first flushing mode, in which ink drops are ejected into the capping member in a state that the nozzle formation face is sealed by the capping member or a second flushing mode, in which ink drops are ejected into the capping member in a state that the capping member is separated from the nozzle formation face, wherein the first flushing mode is performed when a printing operation is not performed; and wherein the second flushing mode is performed when the printing operation is interrupted.

2. An ink jet recording apparatus, comprising:

an ink jet recording head, provided with a nozzle formation face on which nozzle orifices for ejecting ink drops in accordance with print data are formed;

a capping member, which seals the nozzle formation face, the capping member having an inner space formed with a bottom;

an ink absorbing member, provided on the bottom of the inner space in the capping member; and a flushing controller, which selectively performs either a first flushing mode, in which ink drops are ejected into the capping member in a state that the nozzle formation face is sealed by the capping member or a second flushing mode, in which ink drops are ejected into the capping member in a state that the capping member is separated from the nozzle formation face, wherein a distance between the nozzle formation face and the ink absorbing member is variable when the second flushing mode is performed.

3. The recording apparatus as set forth in claim 2, wherein the distance between the nozzle formation face and the ink absorbing member is varied in accordance with a kind of ink ejected.

4. The recording apparatus as set forth in claim 2, wherein ink drops of different kinds of inks are ejected so as to land on a substantially identical position on the ink absorbing member, when the second flushing mode is performed.

5. The recording apparatus as set forth in claim 4, wherein ink drops of a first kind of ink which is easy to solidify are first ejected, and then ink drops of a second kind of ink which is hard to solidify are ejected.

6. The recording apparatus as set forth in claim 2, wherein the number of ink drops ejected is varied in accordance with a kind of ink ejected, when the first flushing mode and the second flushing mode are performed.

7. The ink jet recording apparatus as set forth in claim 2, wherein the ink absorbing member is a single sheet member.

8. A recording apparatus, comprising:

a recording head on which nozzle orifices are formed;

a controller, wherein the controller operates in a first mode in which liquid is ejected from the nozzle orifices when the nozzle orifices are sealed, wherein the controller operates in a second mode in which liquid is ejected from the nozzle orifices when the nozzle orifices are not sealed, wherein the first mode is performed when a recording operation is not performed; and wherein the second mode is performed when the recording operation is interrupted.

9. A recording apparatus, comprising:

a recording head on which nozzle orifices are formed;

an ink absorbing member; and a controller, wherein the controller operates in a first mode in which liquid is ejected from the nozzle orifices when the nozzle orifices are sealed, wherein the controller operates in a second mode in which liquid is ejected from the nozzle orifices when the nozzle orifices are not sealed, wherein a distance between the nozzle orifices and the ink absorbing member is variable when the controller operates in the second mode.

10. The recording apparatus as set forth in claim 9, wherein the distance between the nozzle orifices and the ink absorbing member is varied in accordance with a kind of liquid ejected.

11. The recording apparatus as set forth in claim 9, wherein different kinds of liquid are ejected so as to land on a substantially identical position on the ink absorbing member when the second mode is performed.

12. The recording apparatus as set forth in claim 11, wherein a first kind of liquid is ejected and a second kind of liquid, which is harder to solidify than the first kind of liquid, is ejected after the second kind of liquid.

13. The recording apparatus as set forth in claim 9, wherein the number of drops of liquid ejected varies in accordance with a kind of liquid ejected during the first mode and during the second mode.

14. The recording apparatus as set forth in claim 9, wherein the ink absorbing member is a single sheet member.

15. The recording apparatus as set forth in claim 9, wherein the second mode is performed when a recording operation is interrupted.

* * * * *